US005497972A

United States Patent [19]

Sofy

[11] Patent Number: 5,497,972

[45] Date of Patent: Mar. 12, 1996

[54] STAND FOR ARTIFICIAL CHRISTMAS TREE OR THE LIKE

[75] Inventor: Hugh M. Sofy, Troy, Mich.

[73] Assignee: HMS Mfg. Co., Troy, Mich.

[21] Appl. No.: 329,531

[22] Filed: Oct. 26, 1994

[51] Int. Cl.[6] ..... F16M 13/00

[52] U.S. Cl. ..... 248/523

[58] Field of Search ..... 248/523, 519, 248/511, 514, 346, 515, 516, 527; 47/40.5

[56] References Cited

U.S. PATENT DOCUMENTS

| | | | |
|---|---|---|---|
| 958,644 | 5/1910 | Huff . | |
| 982,866 | 1/1911 | Poppendieck . | |
| 1,411,722 | 4/1922 | Grenzebach . | |
| 1,421,398 | 7/1922 | Burchess | 248/523 |
| 1,706,223 | 3/1929 | Finnegan . | |
| 1,769,127 | 7/1930 | Finnegan . | |
| 2,337,914 | 12/1943 | Meldrum . | |
| 2,454,231 | 11/1948 | Stoick . | |
| 2,609,169 | 9/1952 | Kroeger . | |
| 2,733,032 | 1/1956 | Farley et al. . | |
| 2,879,019 | 3/1959 | Fox . | |
| 2,928,633 | 3/1960 | Holmes et al. | 248/523 X |
| 2,936,144 | 5/1960 | Otis . | |
| 3,052,437 | 9/1962 | Schoen | 248/527 X |
| 3,332,649 | 7/1967 | Morrison . | |
| 3,655,156 | 4/1972 | Petrie | 248/188.7 X |
| 3,863,876 | 2/1975 | Finkelstein et al. | 248/188.7 |
| 4,119,290 | 10/1978 | Gies | 248/523 |
| 4,159,096 | 6/1979 | Chase | 248/523 |
| 4,261,138 | 4/1981 | Syms | 47/40.5 |
| 4,399,973 | 8/1983 | Spry et al. | 248/524 |
| 4,406,437 | 9/1983 | Wright | 248/529 |
| 4,571,881 | 2/1986 | Lathim | 47/40.5 |
| 4,610,356 | 9/1986 | Porter et al. | 47/40.5 X |
| 4,678,089 | 7/1987 | Lang | 211/133 |
| 4,801,123 | 1/1989 | Lynch | 248/524 |
| 5,022,620 | 6/1991 | Scott | 248/188.6 |
| 5,160,110 | 11/1992 | Praegitzer | 248/523 |

*Primary Examiner*—Ramon O. Ramirez
*Attorney, Agent, or Firm*—Howard & Howard

[57] ABSTRACT

A plastic stand assembly (10) is provided for supporting an upright pole (12) such as used with artificial Christmas trees, merchandise display stands or the like. A substantially circular domed body includes an annular flange (20) forming a bearing surface (18). A receptacle (34) is formed in the body and includes a multi-sectioned conically tapering side wall terminating at a bottom (36). A collet (44) surrounds the pole (17) and is wedged into the receptacle (34) to hold the pole (12) in a vertical position. The collet (44) includes an annular neck (46) and four wedge-shaped grippers (48) which extend in cantilever fashion from the neck (46). Screws (48) pass through ears (64) in the collet (44) and thread into sockets (70) in the body to hold the collet (44) tightly wedged into the receptacle (34). A plurality of radial (30) and circumferential (32) ribs are located on the underside of the body for structural rigidity.

20 Claims, 3 Drawing Sheets

STAND FOR ARTIFICIAL CHRISTMAS TREE OR THE LIKE

TECHNICAL FIELD

The subject invention relates to a stand assembly for supporting an upright pole in a vertical position, and more particularly to a stand of the type used with an artificial Christmas tree or a merchandise display stand or the like.

BACKGROUND OF THE INVENTION

Prior art stand assemblies are provided in many applications to form a stable base support for artificial Christmas trees, merchandise display stands, garden umbrellas, and the like. In each of these applications, a pre-fabricated upright pole of usually cylindrical construction is seated into a receptacle in a base of the stand assembly and held therein either by screws, force fit, or some other type of clamping or locking mechanism.

U.S. Pat. No. 4,678,089 to Lang, issued Jul. 7, 1987, discloses a display stand for supporting a tubular upright pole. The open bottom end of the pole is seated over a fixing projection extending upwardly from the bottom of the receptacle, while a centering washer stabilizes the pole at an elevated location. The primary deficiency of the Lang display stand is that, in order for the pole to properly fit within the centering washer and about the fixing projection, the pole must be manufactured to exact tolerances. However, in practice, this is not conveniently possible as prudent business may dictate purchasing the pole from numerous different entities, some of which may base manufacture upon the metric system of measure and others upon the English system of measure. Thus, tolerance variations in the dimension of a pole are certain to occur, which are not adequately addressed in the Lang stand assembly.

U.S. Pat. No. 4,119,290 to Gies, issued Oct. 10, 1978, discloses a stand assembly including three loose piece clamping members supported for sliding movement on a bottom of the stand receptacle. Each clamping member has a sloping exterior surface which reacts against a wedge-shaped setting means. As the setting means is threaded into the receptacle, the clamping members are displaced radially inwardly to clamp on a pole seated in the midst. While the Gies stand assembly is capable of clamping to poles of varying dimensional tolerances, it is a complicated assembly having numerous loose pieces which can be lost or damaged and, by its very design, establishes high frictional forces between the wedging members tending to resist positive and uniform displacement of the clamping members against the pole. Also, the Gies stand is very expensive to produce.

U.S. Pat. No. 1,411,722 to Grenzebach, issued Apr. 4, 1922, discloses a stand assembly including a receptacle which receives a clamping element. The clamping element includes wedge-shaped extensions which react against the side walls of the receptacle to bear inwardly against the pole. The Grenzebach stand assembly is designed to support natural Christmas trees which are relatively heavy. The weight of the natural Christmas tree urges the clamping element downwardly into the receptacles thereby more tightly gripping the surface of the trunk, The Grenzebach stand assembly, however, is unsuitable for artificial Christmas trees, merchandise display stands, or other relatively light structures as the gripping force exerted by the clamping element is dependent upon the weight of the pole and its attendant structures. Also, the Grenzebach stand assembly is designed to release the trunk of the Christmas tree by simply lifting upwardly on the natural Christmas tree, which automatically releases the clamping element. For safety reasons, however, it is desired that artificial Christmas trees, merchandise display stands, and the like be securely fastened to the stand assembly so that deliberate, and intentional release must be undertaken to disassemble the stand assembly from the pole.

SUMMARY OF THE INVENTION AND ADVANTAGES

A stand assembly is provided for an upright pole of the type used with an artificial Christmas tree or the like. The assembly comprises a base having a lowermost bearing surface and a receptacle formed centrally in the base having an inwardly tapering side wall and a bottom elevated above the bearing surface. A collet means is receivable into the receptacle for surrounding and centering the upright pole seated in the receptacle. A fastener means is provided for progressively and enforceably urging the collet into the receptacle. The improvement of the invention resides in the collet means which includes a neck and a plurality of wedge-shaped grippers extending in cantilever fashion from the neck. The wedge-shaped grippers react against the inwardly tapering side wall of the receptacle as the fastener means forcibly urges the collet into the receptacle for gradually and uniformly displacing the grippers inwardly against the upright pole to hold the upright pole in a vertical posture.

The stand assembly of the subject invention overcomes the disadvantages of the prior art by providing a compact, unitary and simple collet means in the form of a neck which surrounds the upright pole, and a plurality of wedge-shaped grippers which flexibly extend from the neck and react against the side wall of the receptacle to grip or clamp about the upright pole. The wedge-shape construction of the grippers accommodate variations in the dimensional peculiarities of the upright pole, thus making the stand assembly compatible with poles manufactured from numerous different sources and to slightly varying dimensional tolerances. Further, the collet means is of simple construction with few components not likely to become lost or mis-installed by the user. The collet means will not crimp or deform the upright pole, as is common when screws are used in prior art stands, and therefore will reliably and consistently hold the pole in a vertical, perpendicular posture time-after-time. Also, the collet means is relatively inexpensive to manufacture. In this manner, the subject invention overcomes the disadvantages of the prior art stand assemblies, while providing a simply operated, less expensive, more durable and more attractive stand assembly.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
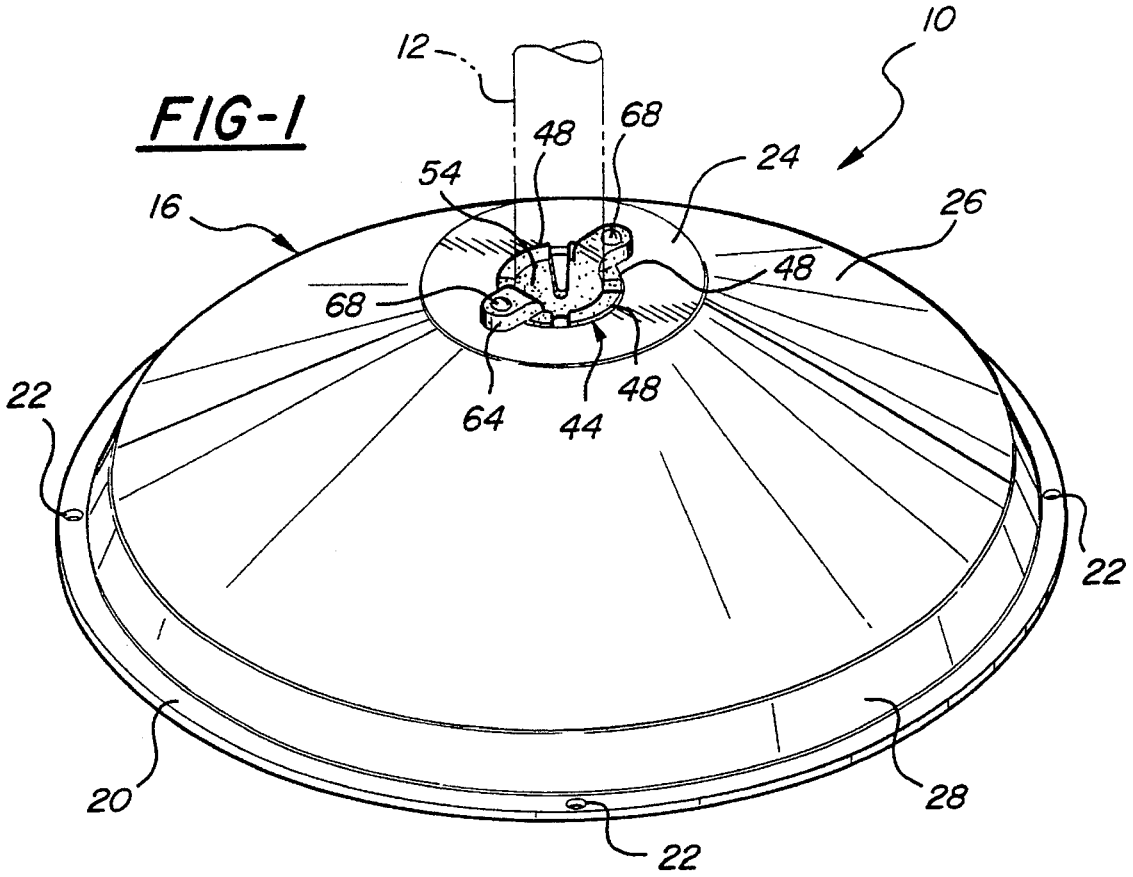
FIG. 1 is a perspective view of the stand assembly of the subject invention showing a fragment of an upright pole in phantom seated in the receptacle.
Figure 2:
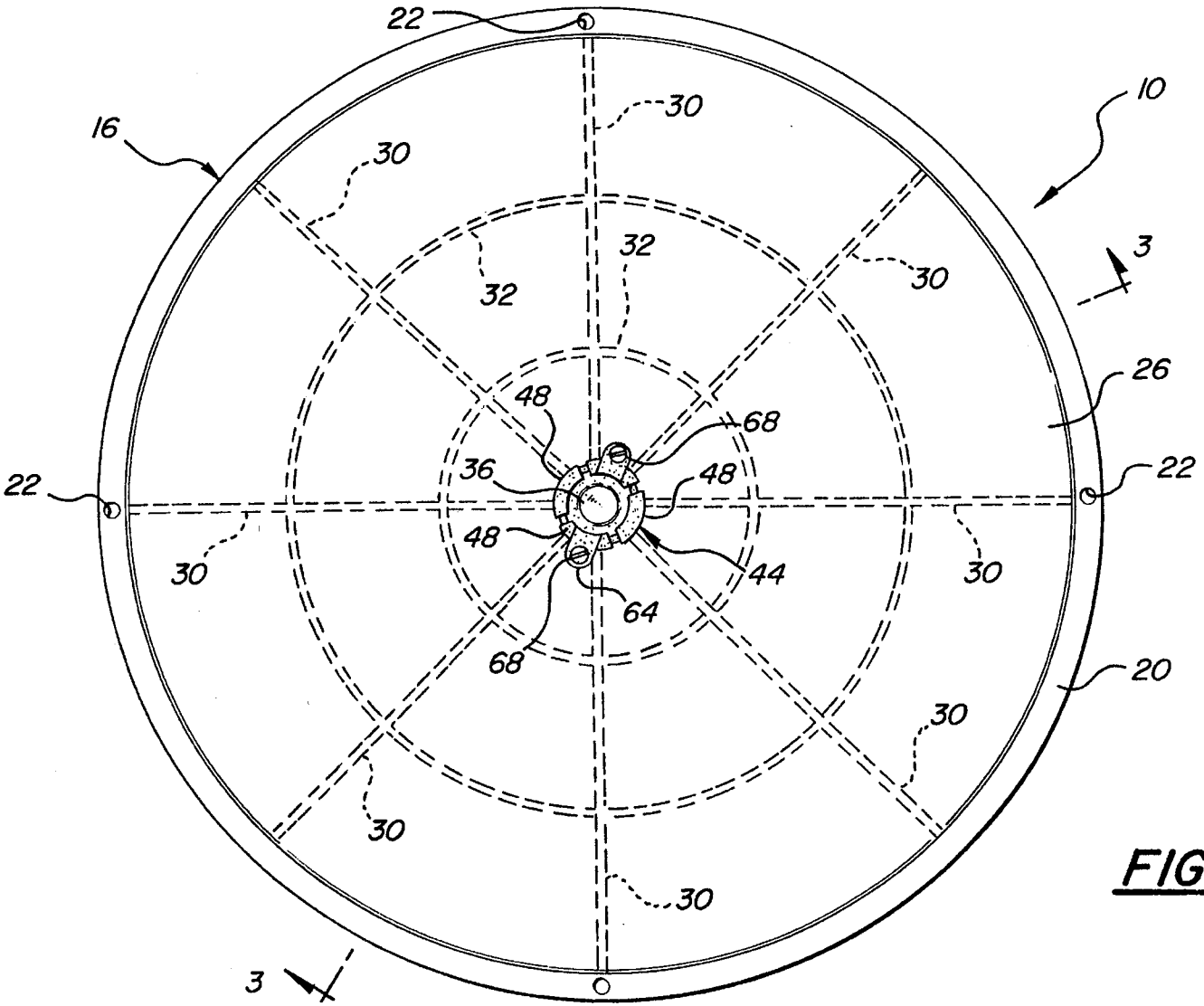
FIG. 2 is a top view of the stand assembly.
Figure 3:
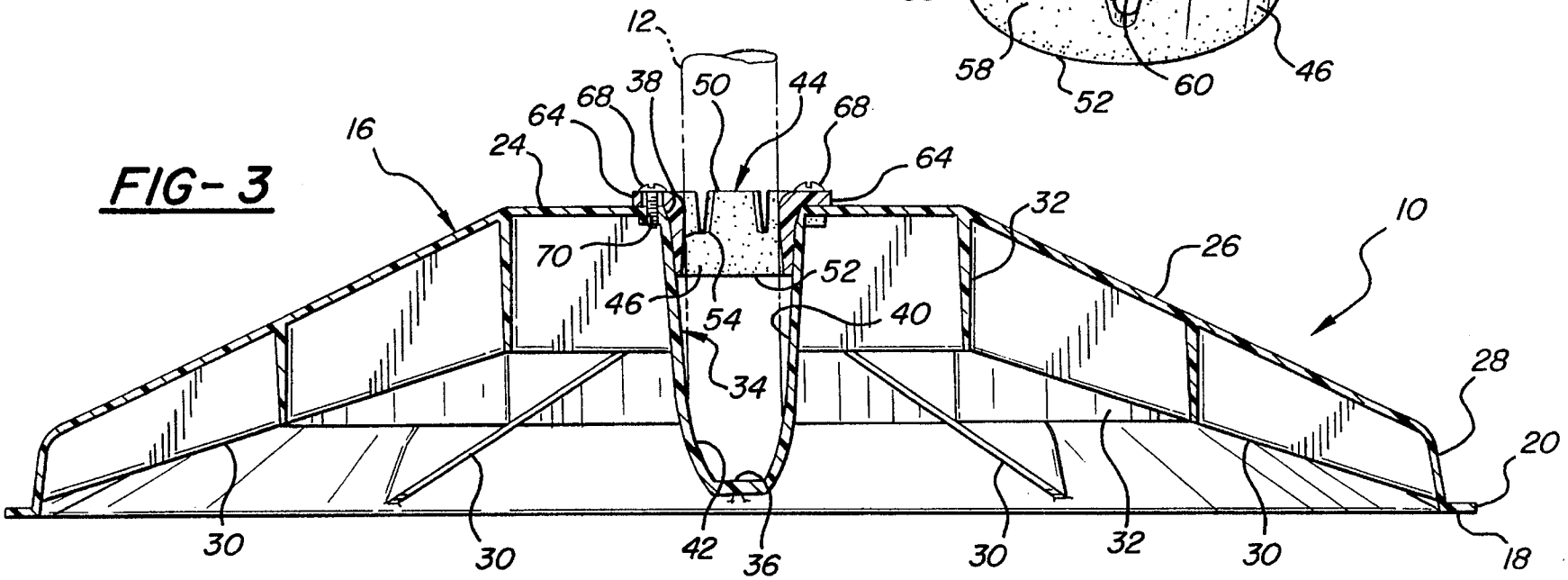
FIG. 3 is a cross-sectional view taken along lines 3—3 of FIG. 2.

Referring to the Figures wherein like numerals indicate like or corresponding parts throughout the several views, a stand assembly according to the subject invention is generally shown at 10 in FIGS. 1 through 3. The stand assembly is provided for supporting an upright pole 12 of the type used with an artificial Christmas tree, merchandise display stand, garden umbrella, etc. Preferably, the pole 12 is a tubular metallic member terminating in a tapered lowered tip 14. The pole 12 may or may not be manufactured with the intent of use in connection with the subject stand assembly 10, and therefore its dimensional tolerances may vary within a relatively large range.

The stand assembly 10 includes a domed based, generally indicated at 16 in FIGS. 1 through 3, having a lowermost bearing surface 18. The bearing surface 18 comprises the smooth ground engaging surface of an annular flange 20 which radiates from the periphery of the base 16. The annular flange 20 may include a plurality of anchor holes 22 through which a nail or screw can be driven to secure the stand assembly 10 to the floor. As best shown in FIG. 2, the base 16 is a generally circular construction having a deck 24, a generally frustoconically sloping skirt 26 and a foot 28 interconnecting the skirt 26 and the annular flange 20. A plurality of radial ribs 30 depend from the base 16, along with a plurality of circumferential ribs 32 which intersect the radial ribs 30. The radial ribs 30 and circumferential ribs 32 structurally rigidify the base 16 while permitting the deck 24, skirt 26 and foot 28 sections to be formed of relatively thin section plastic.

Figure 4:
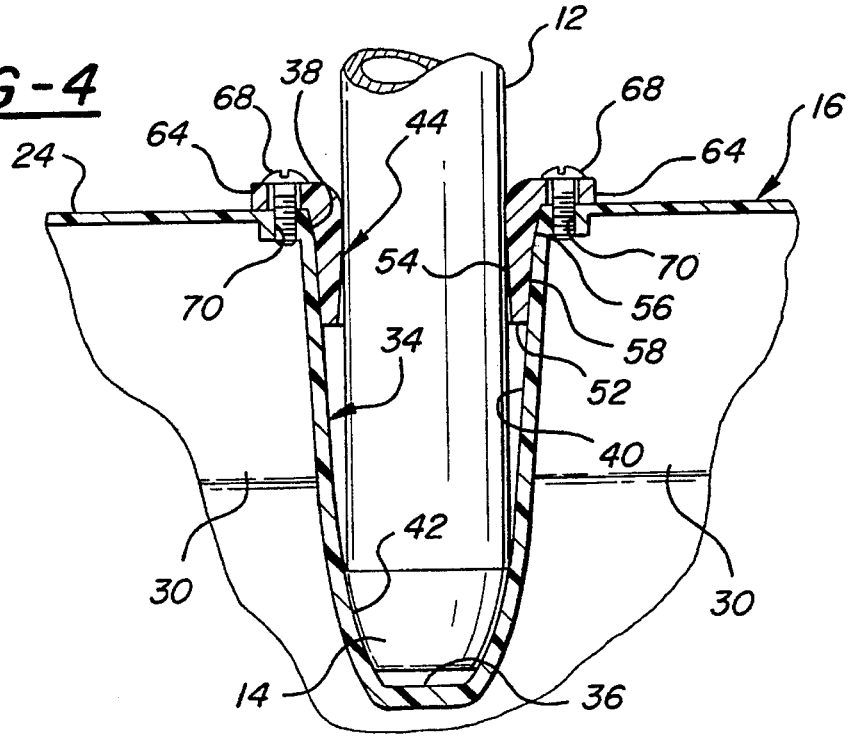
FIG. 4 is an enlarged cross-sectional view of the receptacle showing an upright pole seated therein and clamped in place via the collet means.

A receptacle, generally indicated at 34 in FIGS. 2–4, is formed centrally in the deck 24 portion of the base 16. The receptacle 34 has an inwardly tapering side wall and a bottom 36 elevated above the bearing surface 18. The inwardly tapering side wall of the receptacle 34 includes a first section 38 having a rather steep frustoconical tapers a second section 40, and a third section adjacent the bottom 36 which has a frustoconical taper approximately equal to the tapered lower tip 14 of the pole 12.

Figure 5:
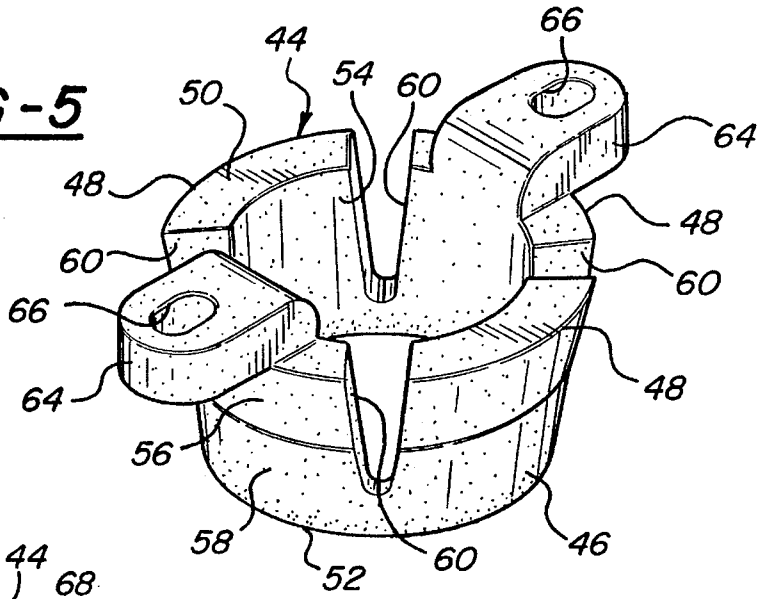
FIG. 5 is a perspective view of the collet means.

A collet means, generally indicated at 44 in FIGS. 1, 4 and 5, is receivable into the receptacle 34 for surrounding and centering the pole 12 when seated in the receptacle 34. The collet means 44 includes an annular neck 46 and a plurality of wedge-shaped grippers 48 extending in cantilever fashion from the neck 46. In the embodiment illustrated in FIGS. 4 and 5, the collet means 44 includes an upper end 50 and a lower end 52, with the neck 46 disposed adjacent the lower end 52 and the grippers 48 extending upwardly therefrom toward the upper end 50. The collet means 44 is generally circular and includes a central passage 54 having a slight frustoconical shape, The central passage 54 has a major diameter adjacent the lower end 52 and a small or minor diameter adjacent the upper end 50. The frustoconical angle of the central passage 54 may be as slight as 3°, which provides certain gripping advantages about the pole 12, to be discussed below, as well as providing a draft angle useful in the plastic injection molding process.

The collet means 44 also includes a compound frustoconical external surface composed of a relatively large angulation upper section 56 adjacent the upper end 50 and a relatively small angulation lower section 58 adjacent the lower end 52. The angulation of the upper section 56 is approximately equal to the frustoconical taper angulation of the first section 38 of the receptacle 34, Likewise, the lower section 58 of the collet means 44 has a frustoconical angulation which is approximately equal to a frustoconical taper provided in the second section 40 the receptacle 34. This geometric relationship is perhaps best illustrated in FIG. 4. Thus, as the collet is advanced into the receptacle 34, a wedging action is created, with the grippers 48 reacting against the side wall of the receptacle 34 to deflect inwardly and bear against the pole 12, thereby snugly and firmly holding the pole 12 in a centered perpendicular position.

The collet means 44 includes a slit 60 between adjacent grippers 48 which extend from the upper end 50 and intersect both the upper and lower sections 56, 58 of the frustoconical exterior surface. Preferably, four such slits are provided, thereby establishing four independent grippers 48. The slits 60 terminate at, and define, the boundary of the neck 46.

In the preferred embodiment, the collet means 44 is molded simultaneously with the base 16, from the same material and in the same mold. This is accomplished by extending runners from the annular flange 20 in the mold cavity of the base 16 to the adjacent mold cavity of the collet means 44. Thus, there are no added handling or manufacturing concerns for the collet means 44, which can easily be broken away from the base 16 and runners after molding. As an added features the stand assembly 10 can be shipped to consumers with multiple collet means 44, each having a different diameter central passage 54, to provide universal application with various diameter poles 12. These multiple collet means 44 can likewise be molded simultaneously with the base 16 in the same mold.

A fastener means, generally indicated at 62 in FIGS. 1–4 is provided for progressively and forcibly urging the collet means 44 into the receptacle 34. In other words, the fastener means 68 advances the collet means 44 more deeply into the receptacle 34, thereby causing the wedge-shaped grippers 48 to react against the inwardly tapering side wall of the receptacle 34 to gradually and uniformly displace the grippers 48 inwardly against the upright pole 12 to hold the pole 12 in a vertical posture. It will be readily appreciated by those skilled in the art that the fastener means 68 may take any one of various forms, such as the threaded collar construction used to hold router bits or other milling tools in a chuck, a simple lever or cam mechanism, a progressive latch, etc. However, the preferred method from a cost, manufacturing and durability standpoint, includes a plurality of ears 64 radiating from respective ones of the grippers 48 adjacent the upper end 50 of the collet means 44. In the embodiment illustrated in the Figures, two ears 64 are provided on diametrically opposed sides of the collet means 44. Each ear 64 includes an elongated, oval-shaped hole 66 for receiving a threaded screw 68. The elongated holes 66 must be stretched in the radial direction to accommodate gripper 48 displacement during installation.

Threaded sockets 70 are formed in the deck 24 of the base 16 for receiving the screws 68. Preferably, the threaded sockets 70 are provided with a build-up of plastic on the underside of the deck 24 to provide added purchase for the screws 68. The socket 70 may be formed during the injection molding process without threads, then self tapped by the screws 68 during the initial installation process.

In operation, the collet means 44 is slipped over the lower tip 14 of the pole 12, with the neck 46 adjacent the lower tip 14. The pole 12 and collet means 44 are then seated in the receptacle 34, with the lower tip 14 being pressed into the third section 42 of the side wall of the receptacle 34, adjacent the bottom 36. The elongated holes 66 and the ears 64 are then aligned with the sockets 70 formed in the deck 24 of the base 16, and the screws 68 threaded into the sockets 70. As these screws 68 are advanced, their heads bear upon the ears 64 to draw the collet means 44 more deeply into the receptacle 34, thereby gradually and uniformly displacing the individual grippers 48 inwardly against the pole 12 to clamp thereabout and hold the pole 12 in a snug vertical posture.

The pole 12 is thus securely fixed in the stand assembly 10 so long as the screws 68 remain undisturbed. To remove the pole from the stand assembly 10, the screws 68 are retreated from the sockets 70 and an upward force placed upon the pole 12 while the base 16 is held steady. This will dislodge the collet means 44 from the receptacle 34, after which the collet means 44 can be removed from the pole 12 and loosely returned to the receptacle 34, along with the screws 68.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A stand assembly (10) for supporting an upright pole (12), said assembly comprising:

a base (16) having a lowermost bearing surface (18); a receptacle (34) formed centrally in said base (16) having an inwardly tapering side wall and a bottom (36) elevated above said bearing surface (18); collet means (44) receivable into said receptacle (34) for surrounding and centering an upright pole (12) seated in the receptacle (34); fastener means (68) for progressively and forcibly urging said collet means (44) into said receptacle (34); and characterized by said collet means (44) including a neck (46) and a plurality of wedge-shaped grippers (48) extending in cantilever fashion from said neck (46), a slit (60) between each of said grippers (48), said wedge-shaped grippers (48) reacting against said inwardly tapering side wall of said receptacle (34) as said fastener means (68) forcibly urges said collet means (44) into said receptacle (34) for gradually and uniformly displacing said grippers (48) inwardly against the upright pole (12) to hold the upright pole (12) in a vertical posture.

2. An assembly as set forth in claim 1 wherein said collet means (44) includes an upper end (50) and a lower end (52), said neck (46) being disposed adjacent said lower end (52) and said grippers (48) extending upwardly therefrom toward said upper end (50).

3. An assembly as set forth in claim 2 wherein said collet means (44) includes a central passage (54) having a frustoconical shape.

4. An assembly as set forth in claim 3 wherein said central passage (54) has a major diameter adjacent said lower end (52) and a smaller minor diameter adjacent said upper end (50).

5. An assembly as set forth in claim 4 wherein said collet means (44) is generally circular.

6. An assembly as set forth in claim 5 wherein said receptacle (34) is generally circular.

7. An assembly as set forth in claim 5 wherein said collet means (44) has a frustoconical external surface.

8. An assembly as set forth in claim 7 wherein said frustoconical exterior surface has a relatively large angulation upper section (56) adjacent said upper end (50) and a relatively small angulation lower section (58) adjacent said lower end (52).

9. An assembly as set forth in claim 8 wherein said slit (60) between each of said gripper (48) extends from said upper end (50) and intersects said upper and lower sections (56, 58) of said frustoconical external surface.

10. An assembly as set forth in claim 9 including four of said slits (60) and four of said grippers (48).

11. An assembly as set forth in claim 8 wherein said side wall of said receptacle (34) includes a first section (38) having a frustoconical taper angulation approximately equal to said upper section angulation of said collet means (44).

12. An assembly as set forth in claim 11 wherein said side wall of said receptacle (34) includes a second section (40) extending from said first section (38) and a third section (42) having a frustoconical taper extending between said second section (40) and said bottom (36).

13. An assembly as set forth in claim 12 wherein at least a portion of said second section (40) has a frustoconical taper angulation approximately equal to said lower section (58) angulation of said collet means (44).

14. An assembly as set forth in claim 6 further including a plurality of ears (64) radiating from respective ones of said grippers (48) adjacent said upper end (50).

15. An assembly as set forth in claim 14 wherein each of said ears (64) includes an elongated hole (66).

16. An assembly as set forth in claim 15 wherein said faster mean (68) includes a plurality of threaded screws, and a plurality of threaded socket (70) formed in said base (16) and associated with each of said threaded screws.

17. An assembly as set forth in claim 6 wherein said base (16) is domed and generally circular.

18. An assembly as set forth in claim 17 wherein said bearing surface (18) is formed on an annular flange (20).

19. An assembly as set forth in claim 18 further including a plurality of radial ribs (30) depending from said base (16) and a plurality of circumferential ribs (32) intersecting said radial ribs (30).

20. A stand (10) and pole (12) assembly, said assembly comprising:

a base (16) having a lowermost bearing surface (18);

a receptacle (34) formed centrally in said base (16) having an inwardly tapering side wall and a bottom (36) elevated above said bearing surface (18);

a cylindrical pole (12) having a lower tip (14) disposed in said receptacle (34) with said lower tip (14) disposed in said receptacle (34) with said lower tip (14) seated adjacent said bottom (36);

a collet (44) including an annular neck (46) and a plurality of wedge-shaped grippers (48) extending in cantilever fashion from said neck (46), a slit (60) between each of said grippers (48), said grippers (48) reacting against said inwardly tapering side wall of said receptacle (34) to gradually and uniformly press against said pole (12); and fastener means (68) for progressively and forcibly urging said collet (44) into said receptacle (44) to retain said pole (12) in a vertical posture.

* * * * *